US005142730A

United States Patent [19]

Braks et al.

[11] Patent Number: 5,142,730

[45] Date of Patent: Sep. 1, 1992

[54] LIQUID SPILL CLEAN-UP DEVICES

[76] Inventors: Jorma G. Braks; Maxime A. Corso, both of 105 Northland Drive, Unit E, Waterloo, Ontario, Canada, N2V 1Y8

[21] Appl. No.: 748,702

[22] Filed: Aug. 22, 1991

[51] Int. Cl.[5] ..... A47L 5/18

[52] U.S. Cl. ..... 15/327.5; 15/314; 15/409

[58] Field of Search ..... 15/409, 327.5, 314

[56] References Cited

U.S. PATENT DOCUMENTS

| | | | |
|---|---|---|---|
| 2,595,752 | 5/1952 | Batts | 15/327.5 X |
| 2,863,525 | 12/1958 | Lucian | 15/409 X |
| 3,286,446 | 11/1966 | Happe et al. | 15/327.5 X |
| 3,971,096 | 7/1976 | Ronholt | 15/409 X |

FOREIGN PATENT DOCUMENTS

| | | | |
|---|---|---|---|
| 937312 | 9/1963 | United Kingdom | 15/409 |
| 1110904 | 4/1968 | United Kingdom | 15/409 |

*Primary Examiner*—Chris K. Moore
*Attorney, Agent, or Firm*—Ridout & Maybee

[57] ABSTRACT

An apparatus for sucking up liquid spills of relatively small volumes is provided, comprising a container to which vacuum can be applied pneumatically, and a pick-up hose and wand. The apparatus is totally free from electrically operated components, so as to eliminate risk of fire-causing sparks during operation, and is light-weight, portable and small in size, so as to be disposed in handy positions adjacent to factory locations where spillage may occur.

4 Claims, 2 Drawing Sheets

LIQUID SPILL CLEAN-UP DEVICES

FIELD OF THE INVENTION

This invention relates to clean-up apparatus for handling liquid spills, particularly chemical liquid spills of relatively small volumes, e.g. three to ten gallons of liquid.

BACKGROUND OF THE INVENTION

As environmental concerns and regulations become more rigorous, the cost and difficulty of dealing with accidental spills and discharges of liquids, particularly hazardous chemical liquids, becomes greater and greater. Small manufacturing operations handling liquid chemical products are unlikely to have accidental liquid spills of a magnitude to cause a potential environmental disaster, but nevertheless they are under obligation to provide as clean and hazard free a working environment as possible. They often do not have the resources to invest in complicated technical spill avoidance and control systems, nor to engage specialist outside operators to handle the problem should an accident of this type occur.

With this greater emphasis on spill control, a significant business has developed in the manufacture and supply of absorbent materials to such companies. These are commonly in the form of sand-like materials, made from clay, booms, oil socks, cellulose, absorbent pads and the like, held in readiness at the site of potential accidents. Any one manufacturing operation may need to stock a variety of different such materials, depending on the variety of liquid chemical materials being handled by the plant.

One problem associated with the use of such absorbents is that the absorbed liquid, which may be quite valuable, is generally not recoverable from them. Another is the on-going high cost of these consumable items. A further, and perhaps the most serious, problem with their use is that it creates yet more unwanted waste material, of potential harm to the environment when discarded.

It is an object of the present invention to provide a novel means and apparatus for picking up liquid spills from floor surfaces.

It is a further object to provide such an apparatus in small, conveniently portable form, for location and convenient use at a variety of locations in a chemical liquid handling plant.

SUMMARY OF THE INVENTION

The present invention provides a vacuum apparatus having a container into which a spilt liquid can be sucked through a flexible hose, the apparatus being operated pneumatically, from a source of compressed air as is commonly available at a large number of places within a chemical handling plant. Accordingly, the apparatus is totally free from any electrically operated parts, and needs no sources of electrical power, mains electricity, batteries or otherwise. There is therefore no risk whatsoever of the creation of any electrical spark to cause a fire hazard when picking up spills of potentially inflammable liquid.

Moreover, the apparatus according to the invention makes no use of absorbent materials, so that there is no solid waste material to be discarded. The spilt liquid is recovered in the container in a form in which it is recoverable and re-usable after only minor cleaning and purification. It is light weight and portable, adapted to be stored adjacent a compressed air outlet in the premises in which it is to be used, for the handling of spills of liquids of relatively small quantity. Thus an operator can react quickly to the occurrence of a spill, connect up and use the apparatus promptly after the spill occurs, without the exercise of any particular operating skills, so as to clean up the spill very rapidly and hence limit the potential damage from it.

BRIEF REFERENCE TO THE DRAWINGS

In the drawings, like reference numerals indicate like parts.

DESCRIPTION OF THE PREFERRED EMBODIMENTS

Preferably, the container has a volumetric capacity of from about three to ten gallons, so that it is of a convenient size for a one-person operation, and for storage in a wall mounted condition. Most of the spills of chemical liquid which occur in small to medium size chemical manufacturing plants are of about the five gallon size, and it is to these types of accidents that the apparatus of the present invention is primarily directed. The preferred embodiment also includes mounting means permitting it to be releasably mounted to a wall, e.g. by means of a wall mounted bracket having a bottom platform to receive the base of the container and a depending hook formation to engage releasably over a top protrusion such as a lip on the container.

When the unit is to be used to clean up volatile liquids or warm liquids likely to vapourize under the vacuums generated, it is preferred to include a demister in the outlet from the suction means, to limit the amount of vapour issued to the environment of the operator.

It is also preferred to incorporate an automatic shut-off valve in the suction means, operated by the rising level of liquid in the container, to guard against overfilling of the container.

Thus the preferred form of the invention is of relatively small size, light weight and easily transportable by a male or female operator, whilst still meeting the volume criteria for the majority of liquid chemical spills. After use, the contents of the container can be emptied to a purification station such as a filtration unit appropriate for the nature of the spilt liquid, and the liquid readily recovered for re-cycle and re-use in the plant. There is no significant amount of waste product to pose a disposal problem.

SPECIFIC DESCRIPTION OF THE MOST PREFERRED EMBODIMENT

Figure 1:
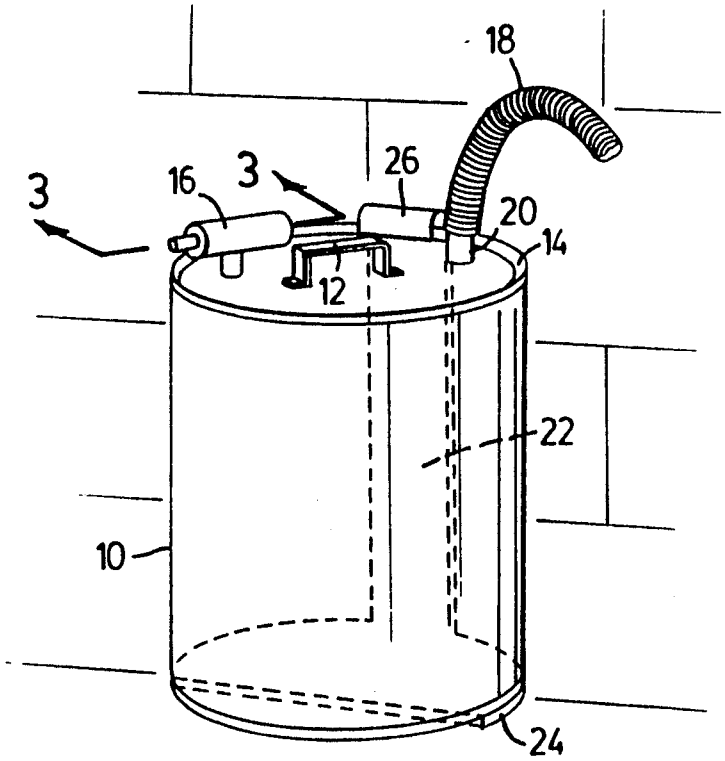
FIG. 1 is a diagrammatic perspective view of the most preferred embodiment of an apparatus according to the invention.

FIG. 1 of the accompanying drawings shows the apparatus of the invention mounted in storage position on a factory wall. The apparatus comprises a cylindrical drum container 10 provided in its top wall with a carrying handle 12, an upstanding peripheral lip 14 and a pneumatically operated suction means 16. A flexible hose 18 protrudes from the top of the container, with its proximal end 20 communicating with the interior of the container 10. A bracket 22 is mounted on the wall, the bracket having a lower platform 24 on which the bottom of the container 10 is supported, and an upper holding means 26 in the form a depending hooked formation which fits over the peripheral lip 14 of the container 10 to retain it in position.

Figure 2:
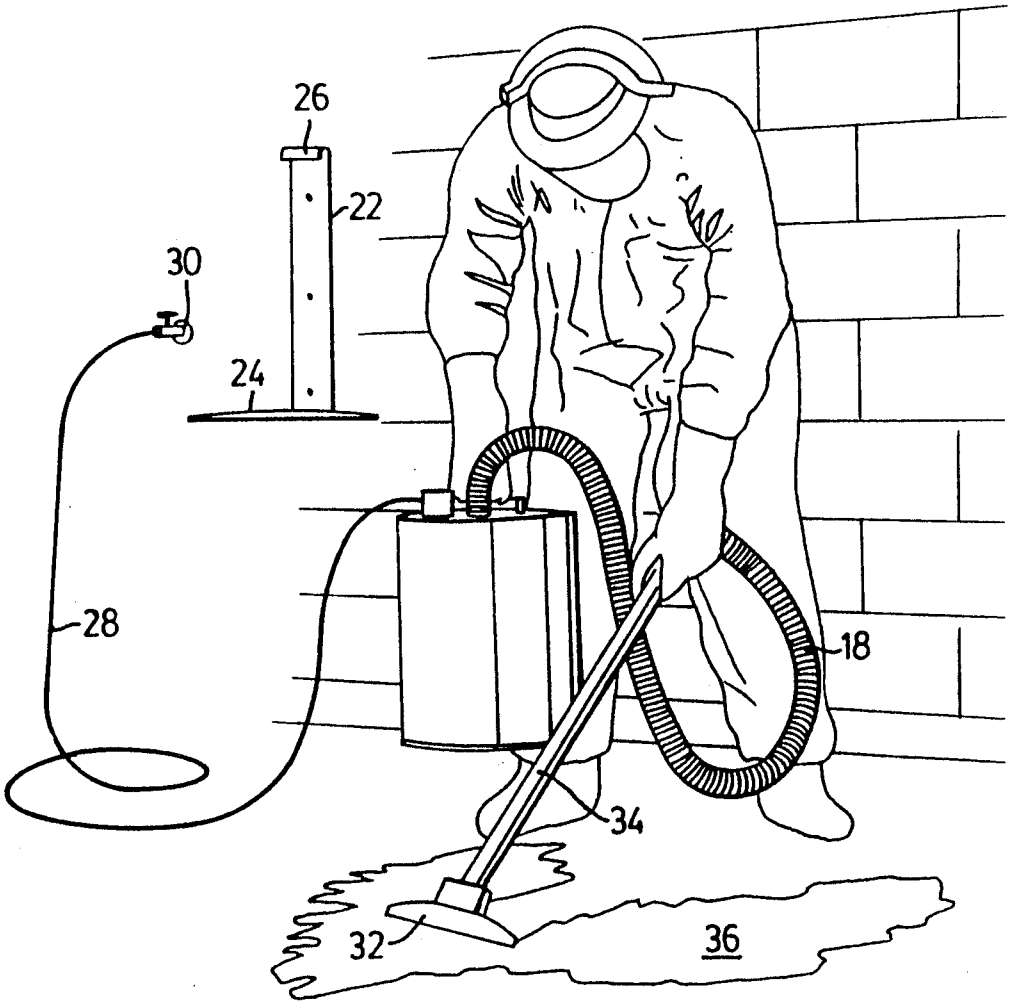
FIG. 2 is an illustration of the apparatus of FIG. 1 in use.

FIG. 2 shows the apparatus of FIG. 1 in operation. A compressed air line 28 connects the suction means 16 to a compressed air outlet 30 in the wall, supplied from a central compressor. The distal end of the flexible hose 18 is provided with a pick-up head 32 on the end of a wand 34, to apply to the puddle 36 of spilt liquid.

Figures 3, 4:
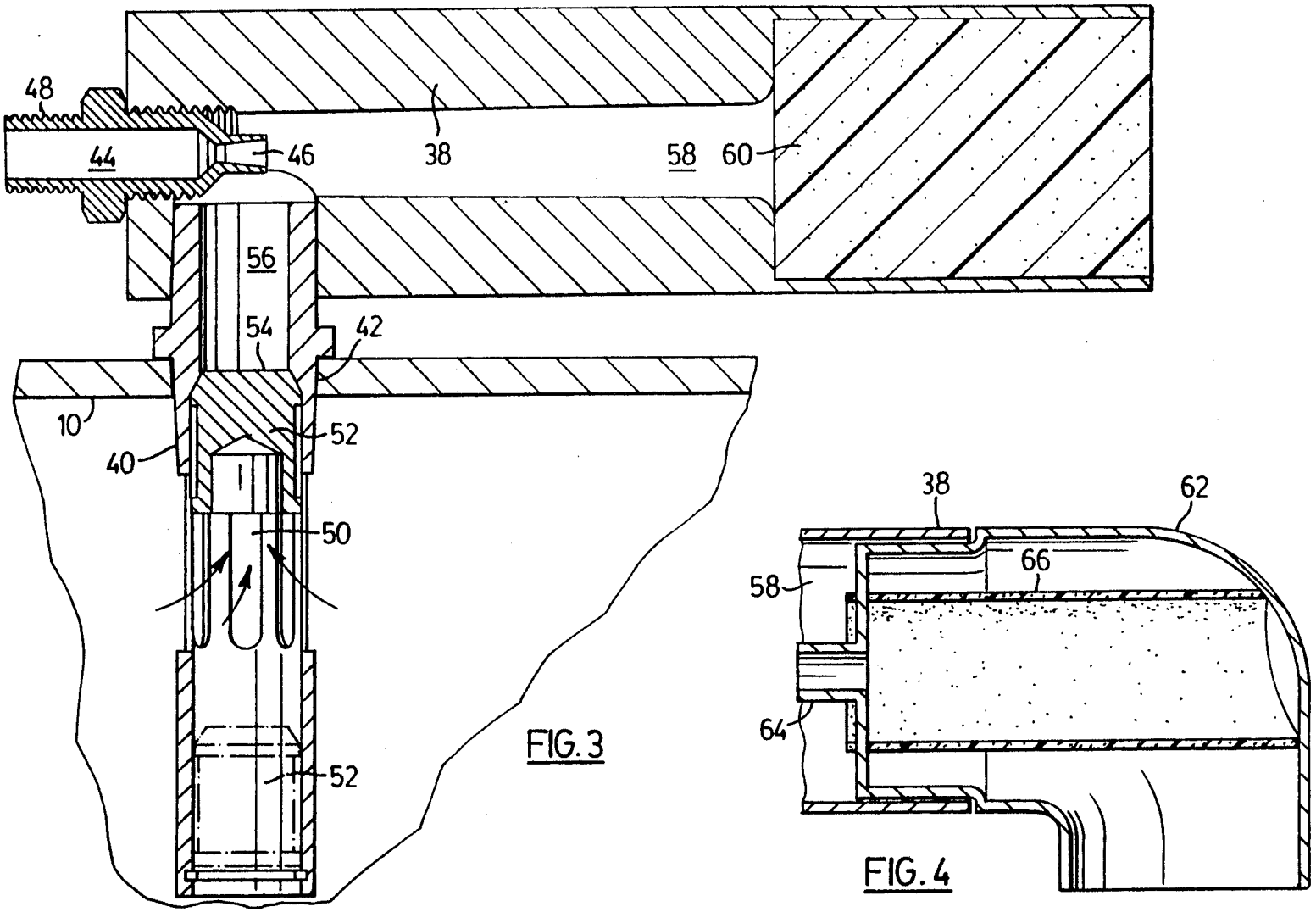
FIG. 3 is a sectional view along the line 3—3 of FIG. 1, of the pneumatically operated suction means of the apparatus of FIG. 1.
FIG. 4 is a sectional view similar to FIG. 3, showing an alternative form of exit from the suction means.

FIG. 3 shows, in sectional view, more detail of the suction means 16. A horizontal tube 38 interconnects with a vertical tube 40 protruding downwardly into the interior of, and sealed to an aperture 42 in the top wall of, the container 10. The inlet end of the horizontal tube 38 is screw threaded to receive therein a venturi tube 44, with a conventional venturi nozzle 46 disposed substantially vertically above the communication with the vertical tube 40. Exteriorly of the horizontal tube 38, the venturi tube 44 is screw threaded at 48 for connection to the air line 28.

The vertical tube 40 is closed at its lower end and is provided with a series of slots 50 in its side wall allowing liquid and air communication from the interior of the container 10 into the tube 40. A float 52, shown in full lines in its upper, closing position and in chain dots in its lower, open position in FIG. 3, is disposed in the vertical tube 40, to act as a safety shut-off. When raised to the upper, closing position in response to filling the container with liquid, it seats against the lower end 54 of the upper part 56 of the vertical tube and closes it off.

The outlet end 58 of the horizontal tube 38 is enlarged into a chamber, in which is provided a sound muffling pad 60 of loosely woven fibrous material, to dampen the sound of the air flows through the apparatus.

In operation, as soon as a puddle 36 is created by spillage, the operator removes the apparatus from the wall bracket 22 and connects air line 28 between the compressed air source 30 and the inlet 48 to the venturi tube 44. As the compressed air issues through the venturi nozzle 46, it reduces the air pressure in the container 10 so that the liquid from the spill puddle 36 is sucked into the container through the hose 18. If the container becomes too full of liquid, the float 52 rises to close the vertical tube 40, and then the container is disconnected ready for emptying. If the complete spill has not been sucked up by this time, there is ample opportunity during the filling process to bring in and connect up another similar apparatus to finish the job, or to empty the container for re-use.

FIG. 4 illustrates diagrammatically an alternative exit arrangement for the suction means 16. In this arrangement, the sound muffling pad 60 is not present in the enlarged outlet end 58. A demister 62 is secured to the end of the outlet end 58, the demister 62 taking the form of an elbow pipe, directed downwardly at 90° to the horizontal tube 38 of the suction means 16, so as to minimize splashing. The demister 62 is provided with a narrow upstream inlet 64 through which air and vapours enter, and a cylindrical gas permeable tube 66 secured to the walls of the demister 62, to act as a sound dampening means. The air enters the inside of tube 66, and exists through its walls. The tube 66 is made of a material which is substantially unaffected by the chemical vapours contacting it. Loosely woven polyethylene or polypropylene fibrous materials are normally suitable.

I claim:

1. Apparatus for picking up spilt liquids from floor surfaces, comprising:

a container for receiving the spilt liquid, said container having a capacity of from about three to about ten gallons, and being provided with mounting means to allow the apparatus to be mounted manually and stored on a wall surface in an elevated position;

said mounting means of the container comprising an upstanding peripheral lip surrounding the top edge of the container adapted to be received and held by a depending hooked formation of a wall-mounted bracket, and a generally flat base adapted to rest on a flat base of the wall bracket spaced a distance from the hooked formation substantially corresponding to the height of the container;

a flexible hose having a proximal end communicating with the interior of the container and a distal and equipped with a pick-up head;

pneumatically operated suction means adapted to create reduced pressure in the interior of said container to effect drawing of liquid from the distal end of the hose into the container;

a shut off valve incorporated in the suction means, adapted to shut off the suction means when the container is filled with liquid to a predetermined level;

connection means for connecting said suction means to a source of compressed gas;

said apparatus being constructed entirely from non-electrically operated components.

2. Apparatus according to claim 1, further including a carrying handle on the upper surface of the container.

3. In combination, an apparatus for picking up spilt liquids and comprising a container for receiving the spilt liquid and having a releasable mounting means at its upper periphery, a flexible hose having a proximal end communicating with the interior of the container and a distal end for picking up the liquid, an pneumatic suction means adapted to create condition of reduced pressure in the container when connected to a source of compressed gas, and a wall mounting bracket for releasably receiving and mounting said apparatus, said bracket including an upper holding means to co-operate with the mounting means on the container, and a lower platform to receive and support the bottom of the container when the mounting means thereof is in co-operation with the holding means of the bracket;

the mounting means on the container comprising a peripheral lip upstanding from the top edge of the container, and the upper holding means of the bracket comprising a depending hooked formation adapted and positioned to engage over the upstanding lip of the container when the container is supported on the lower platform of the bracket.

4. Apparatus according to claim 1, further including a demister at the exit from the pneumatically operated suction means.

* * * * *